United States Patent [19]

Rall

[11] Patent Number: 4,676,486

[45] Date of Patent: Jun. 30, 1987

[54] REACTION VESSEL FOR SMELTING IRON ORE AND METHOD

[76] Inventor: Waldo Rall, 100 Oxford Dr., Apt. 805, Monroeville, Pa. 15146

[21] Appl. No.: 831,169

[22] Filed: Feb. 20, 1986

[51] Int. Cl.[4] ..... C21C 5/42

[52] U.S. Cl. ..... 266/44; 266/282; 266/900

[58] Field of Search ..... 266/44, 282, 280, 900; 75/0.5 R, 43, 45

[56] References Cited

U.S. PATENT DOCUMENTS 2,022,372 11/1935 Hopkins ..... 266/44

3,916,047 10/1975 Niesen ..... 266/282

*Primary Examiner*—L. Dewayne Rutledge

*Assistant Examiner*—S. Kastler

*Attorney, Agent, or Firm*—B. B. Olive

[57] ABSTRACT

Attack of the refractory containment by the slag in an ironmaking or steelmaking vessel is prevented by means providing a continuously replenished thin film of liquid iron or steel between the slag and the refractory.

21 Claims, 3 Drawing Figures

REACTION VESSEL FOR SMELTING IRON ORE AND METHOD

TECHNICAL FIELD

The invention relates to the production of iron or steel in a reaction vessel and more specifically to means for reducing attack of the refractory containment by the slag.

BACKGROUND ART

Various iron-ore direct reduction processes have been developed but have not been commercialized because of the problem of too rapid attack of the refractory lining of the reaction vessel by the high-FeO slag. One attempt to circumvent this problem has involved water cooling of the vessel lining to provide a solidifed scull of the high-FeO slag for containment of the slag. However, when attempts were made to scale up this solidified-scull system from pilot to commerical size, it was found that water cooling requirements became excessive and produced an unacceptable energy loss. Examples of such processes are to be found in U.S. Pat. No. 3,264,096 and in the so-called INRED process developed by Boliden Kemi AB of Sweden.

Pertinent to the invention is prior recognition that certain refractory materials now in an experimental but promising state can be made inherently porous to molten iron or steel. Sintered alumina, sintered magnesia and sintered magnesia-chromia systems have been recognized in this regard with sintered alumina being presently the most promising such material for purposes of the present invention.

DISCLOSURE OF INVENTION

According to the present invention, attack of the refractory by the high-FeO slag in a reaction vessel for smelting iron ore is prevented by providing a continuously replenished, thin film of liquid iron or liquid steel between the slag and the refractory. Such film is provided in one embodiment by seeping or oozing liquid iron or steel through a specially designed porous refractory using the ferrostatic head of a reservoir of liquid iron or steel as the driving force. The porous refractory is made porous to the film forming molten metal, iron or steel, by forming the refractory of an inherently porous material or by forming passages, as by drilling, to establish the porous character. In another embodiment, the film is established by floating liquid iron or steel over the lip of a refractory barrier. Molten iron is used for the protective film in the illustrated embodiment though the invention is equally applicable to the use of molten steel as the protective film in steelmaking, where the slag is also reactive but somewhat less reactive than in ironmaking.

BEST MODE FOR CARRYING OUT THE INVENTION

Figure 1:
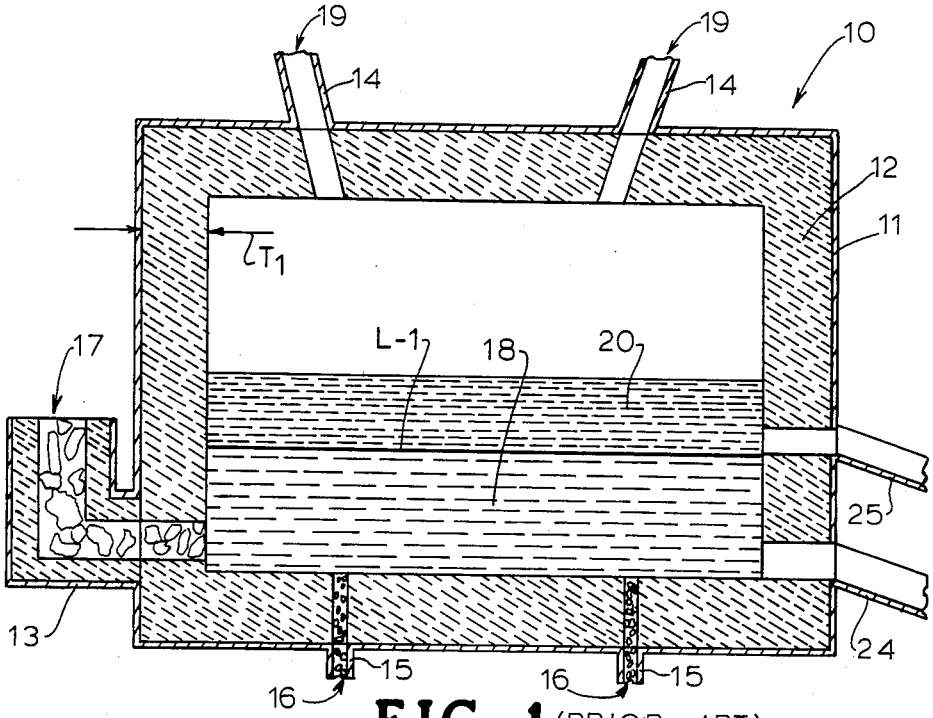
FIG. 1 (PRIOR ART)
FIG. 1 is a schematic elevation, largely in section, through an ore-smelting vessel illustrating prior art construction.

Referring initially to FIG. 1, the conventional prior art or smelting vessel 10 comprises a cylindrical steel shell 11 with a refractory liner 12 that is typically magnesite brick. Molten ore is introduced through penetration 13, oxygen through penetrations 14, and fuel, such as powdered coal, through bottom tuyeres 15. As more specially and adequately described in U.S. Pat. No. 3,264,096 to which reference is made for more detailed understanding, the coal 16 reacts endothermically with the ore 17, reducing it to molten iron 18 and forming carbon monoxide (CO). The heat needed for the endothermic reaction is provided by the combustion of the CO with oxygen 19 in the freeboard above the molten iron 18 and molten slag 20. The slag above reference level L-1 is composed of flux added with the molten ore, gangue from the ore, ash from the coal, and some FeO. The slag, especially high-FeO slag, will attack the magnesite brick in lining 12 and most other commercial refractories and this is particularly true with respect to that portion of the refractory lining 12 which lines the sides of the vessel 10 with which the molten slag 20 is in immediate contact. Iron and slag are tapped through respective penetrations 24, 25.

According to a first embodiment of the invention illustrated in FIG. 2, the side wall refractory lining 12 which normally is in immediate contact with the molten slag 20 is replaced with a cylindrical layer of refractory 21 which s porous to molten iron, typically sintered alumina, extending from above the maximum expected top elevation of the slag layer 20 to below the minimum expected elevation of the bottom of the slag layer 20 into the layer 18 of molten iron. An air space 22 behind the porous refractory 21 is partially filled with molten iron 23. The thicknesses of the poruos refractory layer 21, the liquid iron layer 23 and the remaining refractory side wall layer 12 are chosen accoring the their thermal conductivities so as to maintain the iron layer 23 molten as the heat flux from the freeboard combustion and from the molten slag 20 passes through to the steel shell 11 which is cooled by the atmosphere. The maintenance of the iron layer 23 in a molten state is readily accomplished. In this regard, the porous refractory 21, up to the level L-2 of the molten iron 23, exhibits a thermal conductivity only slightly less than that of the iron 23 because of the iron 23 seeping through the refractory 21. Thus, for a typical refractory lining thickness $T_1$ (FIG. 1) of ten to thirty inches, the thickness $T_2$ of porous refractory 21 can be in the range of one-half to two inches and the thickness $T_3$ of molten iron layer 23 can be in the range of one to three inches. As the iron making process proceeds, the iron and the slag may be tapped through the respective penetrations 24 and 25.

Figure 2:
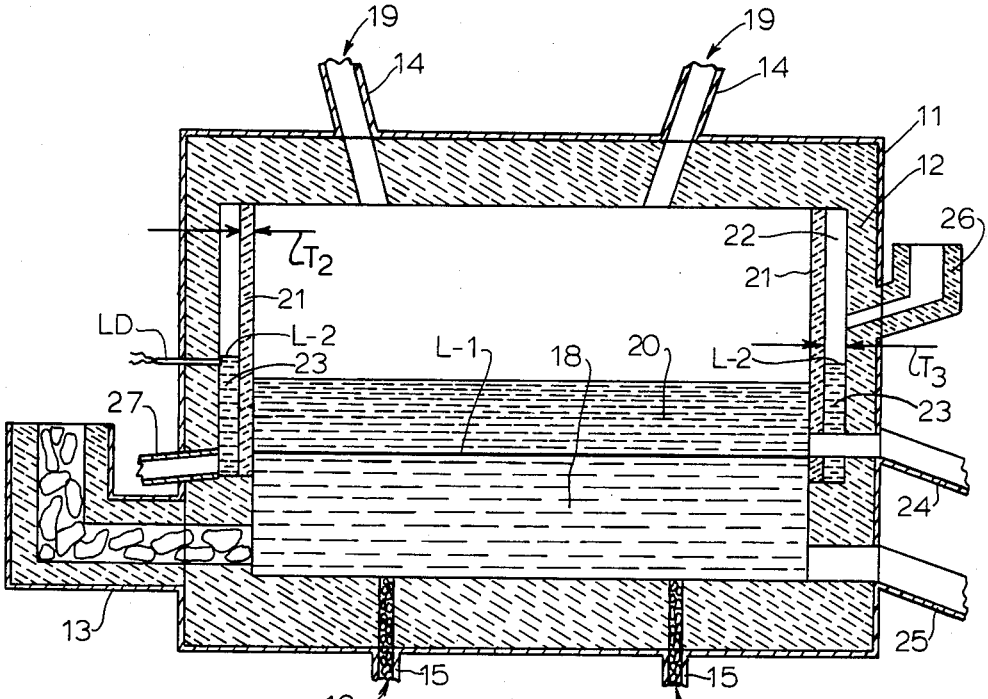
FIG. 2 is a schematic elevation, largely in section, through a modified prior art ore smelting vessel illustrating in a first embodiment means for maintaining a level of molten iron behind and a film of molten iron in front of and flowed through porous refractory.

With continuing reference to FIG. 2, penetration 26 allows molten iron to be added to the space 22 above molten iron 23 that seeps through the porous refractory 21. Level detectors, generally designated LD, such as thermocouples or electromagnetic sensors, may be used to indicate the need to make iron additions to the layer 23. Although molten iron additions are the most straightforward, solid additions, such as shredded or chopped scrap, could also be introduced through penetration 26 provided there is adequate heat flux from the freeboard. Another penetration 27 is provided to drain the molten iron 23 into a ladle for shutdown, since the contraction accompanying solidification would be expected to place too much stress on the porous refractory layer 21 to permit retention of the iron layer as a perimeter. It is contemplated however that special designs may be used to break the perimeter of the iron layer into numerous, harmless segments.

Figure 3:
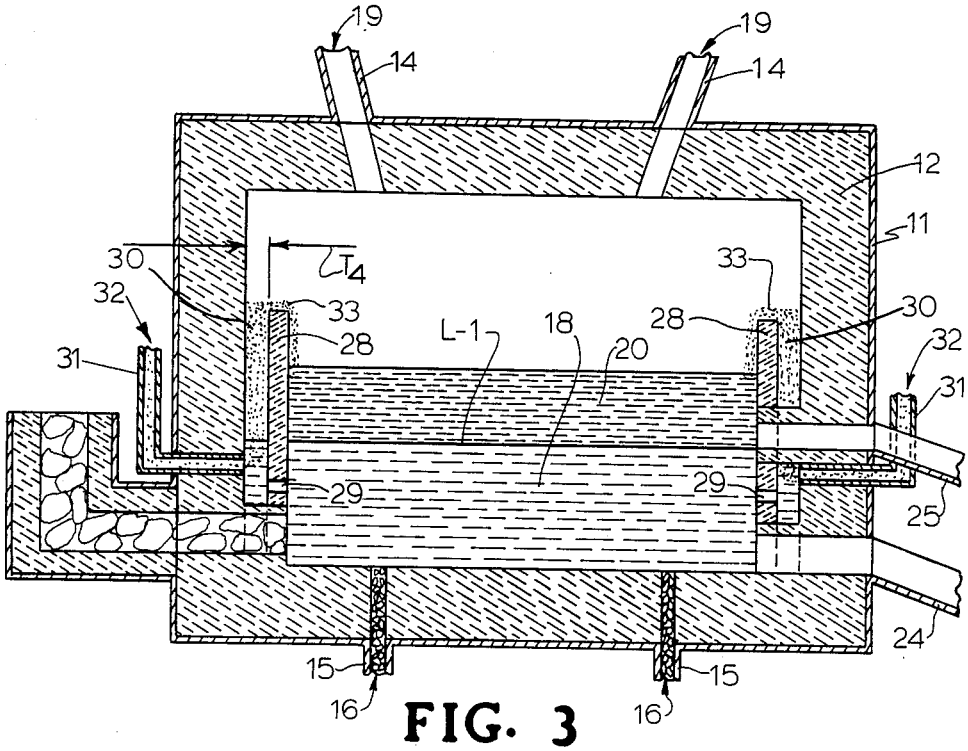
FIG. 3 is a schematic elevation, largely in section, through a modified prior art ore-smelting vessel illustrating in a second embodiment means for flowing a film of molten iron over the rim of a refractory liner and causing the film to establish itself between the slag and the refractory lining.

FIG. 3 illustrates in a second embodiment of the invention an alternative to the use of a porous refractory through which molten iron seeps to protect the outer refractory lining 12. Specifically, a non-porous cylindrical liner 28 is spaced apart from and within the refractory wall 12 of the vessel and extends from above the maximum expected top elevation of the slag layer 20 to below the minimum expected elevation of the bottom of the slag layer 20 into the layer of molten iron 18. The liner 28 has openings 29 so that molten iron 18 communicates with molten iron in region 30, which typically has a thickness $T_4$ of one to two inches. A plurality of peripherally spaced tuyeres 31 introduce an inert gas 32, such as argon, that is typically used for stirring in steel refining operations, into the molten iron in region 30 thereby reducing the density of that molten iron. The level of this reduced density molten iron therefore rises as the result of ferrostatic pressure from the higher-density molten iron in region 18. The flow rate of the inert gas 32 through plural tuyeres 31 is adjusted so that the reduced density molten iron flows slowly, but constantly, over the lip 33 of the refractory liner 28 and as a film downwardly on the inner face of liner 28 and through slag 20 to again collect with molten iron 18. Thus, the slag 20 created by the reduction of the molten ore never contacts the refractory barrier 28.

In a third embodiment, not illustrated, it is recognized that the liner 28 of FIG. 3 could be made of a porous refractory such as sintered alumina. In such embodiment, the lower density moten iron is allowed to seep through such porous liner rather than float over the liner to establish the desired protection.

In a fourth embodiment, not illsutrated, the refractory 21 is made porous to the molten iron or steel being used for the protective film by forming such refractory 21 from an initially non-porous refractory material made porous by forming holes of sufficient size through the thickness of the refractory to permit the film forming molten iron or steel to seep through the refractory. Thus, the protective refractory may be made from a material inherently porous to molten iron or steel or made porous by forming passages through the selected refractory. In the FIG. 2 embodiment for example refractory liner 21 could be made porous to the molten metal, iron or steel, by drilling many small holes through liner 21 using a diamond or laser drill for example. Such holes would pass through liner 21 above the top of the slag 20 approximately at lever L-2.

In a fifth embodiment, not illustrated, the refractory 21 of FIG. 2 is made from an inherently porous refractory having supplemental passages formed to enhance the desired film forming seepage.

From the foregoing, it can be seen that a substantially improved apparatus and method are provided for preventing the slag attack of the refractory liner in ironmaking and steelmaking vessels. While iron was used in the illustrative embodiment, those skilled in the art will readily appreciate application to steelmaking vessels wherein the molten-iron film would be replaced by a molten-steel film.

What is claimed is:

1. A method for protecting the refractory liner of an ironmaking or steelmaking vessel from attack by a layer of corrosive molten slag confined within said vessel, comprising the steps:

(a) establishing and continuously maintaining at a location within the vessel but external of the layer of slag an auxiliary source of molten metal selected from the group consisting of molten iron and steel; and (b) establishing and continuously maintaining a film of said molten metal obtained from said auxiliary source between said vessel liner and said layer of slag in a manner wherein said layer of slag is presented from making direct contact with said vessel liner.

2. A method for protecting the refractory liner of an iron-making or steelmaking vessel from attack by a layer of corrosive molten slag confined within said vessel, comprising the steps:

(a) establishing and continuously maintaining at a location within the vessel but external of the layer of slag an auxiliary source of molten metal selected from the group consisting of molten iron and steel;

(b) isolating said source of molten metal from said slag by means of an auxiliary porous refractory liner surrounding said slag and spaced inwardly of said vessel liner and collecting said source of molten metal in a space formed between said vessel inner and said auxiliary refractory liner; and (c) establishing and continuously maintaining said source of molten metal under ferrostatic pressure to cause said molten metal to seep through said auxiliary refractory liner and form a film of said molten metal obtained from said auxiliary source as a continuous descending film between the inner surface of said auxiliary refractory liner and said layer of slag wherein said layer of slag is prevented from making direct contact with said vessel liner.

3. The method of claim 21 wherein said porous refractory liner made of a material inherently porous to said molten metal.

4. The method of claim 3 wherein said porous refractory liner material is formed with passages porous to said molten metal thereby enabling molten metal from said auxiliary source to seep through said porous refractory liner both by reason of the inherent porous character of said material and by the presence of said passages.

5. The method of claim 2 wherein said porous refractory liner is made of a material having formed passages porous to said molten metal.

6. A vessel for ironmaking or steelmaking and of the type having a refractory vessel liner subject to corrosive attack by a layer of slag floating on molten metal, comprising:

(a) means within the vessel for establishing and continuously maintaining an auxiliary source of molten metal surrounding but isolated from the layer of slag; and (b) means for establishing and continuously maintaining a film of said molten metal obtained from said auxiliary source of molten metal between said vessel liner and said layer of slag in a manner wherein said layer of slag is prevented from making direct contact with said vessel liner.

7. A vessel as claimed in claim 6 including means for draining said auxiliary source of molten metal from said vessel.

8. A method for protecting the refractory liner of an ironmaking or steelmaking vessel from attack by a layer of corrosive molten slag confined within said vessel, comprising the steps:

(a) establishing and continuously maintaining at a location within the vessel but external of the layer of slag an auxiliary source of molten metal selected from the group consisting of molten iron and steel; and (b) establishing an auxiliary non-porous refractory liner spaced inwardly of said vessel liner and extending above and below the layer of said slag for containing said slag and molten metal below said slag;

(c) communicating said molten metal below said slag to the space between said vessel liner and said auxiliary liner to establish and continuously maintain said auxiliary source of molten metal; and (d) introducing an inert gas into said auxiliary source of molten metal through plural entries at a level below said layer of slag to decrease the density of said source of molten metal enabling the metal in said source of molten metal to float upwardly and trickle down the inner surface of said auxiliary liner to establish and maintain a continuous film of said molten metal obtained from said auxiliary source between said auxiliary liner and said layer of slag in a manner wherein said layer of slag is prevented from making direct contact with said vessel liner.

9. A method for protecting the refractory liner of an ironmaking or steelmaking vessel from attack by a layer of corrosive molten slag confined within said vessel, comprising the steps:

(a) establishing and continuously maintaining at a location within the vessel but external of the layer of slag an auxiliary source of molten metal selected from the group consisting of molten iron and steel; and (b) establishing an auxiliary porous refractory liner spaced inwardly of said vessel liner and extending above and below the layer of said slag for containing said slag and molten metal below said slag;

(c) communicating said molten metal below said slag to space between said vessel and auxiliary liners to establish and continuously maintain said auxiliary source of molten metal; and (d) introducing an inert gas into said auxiliary source of molten metal through plural entries at a level below said layer of slag to decrease the density of said source of molten metal enabling the metal in said source of molten metal to float upwardly and trickle down the inner surface of said auxiliary liner to establish and continuously maintain a film of said molten metal obtained from said auxiliary source and additional molten metal obtained from said auxiliary source to seep through said auxiliary liner to combine with and supplement other molten metal trickling down and forming said film in a manenr wherein said layer of slag is prevented from making direct contact with said vessel liner.

10. A vessel for ironmaking or steelmaking having a refractory vessel liner subject to corrosive attack by a layer of slag floating on molten metal, comprising:

(a) means within the vessel for establishing and continuously maintaining an auxiliary source of molten metal surrounding but isolated from the layer of slag;

(b) said means for establishing and continuously maintaining said auxiliary source of molten metal including an auxiliary porous refractory liner surrounding said layer of slag and spaced inwardly of said vessel liner and having said source of molten metal collected in the space formed between said vessel liner and said auxiliary refractory liner; and (c) means for establishing and continuously maintaining said source of molten metal under ferrostatic pressure to cause said molten metal to seep through said auxiliary porous refractory liner and form a film of said molten metal obtained from said auxiliary source of molten metal as a continuous descending film between the inner surface of said auxiliary porous refractory liner and said layer of slag wherein said layer of slag is prevented from making direct contact with said vessel liner.

11. A vessel as claimed in claim 10 wherein said auxiliary porous refractory liner is made of a material inherently porous to said molten metal.

12. A vessel as claimed in claim 11 wherein said material includes formed passages porous to said molten metal thereby enabling molten metal from said auxiliary source to seep through said auxiliary porous refractory liner both by reason of the inherent porous character of said material and by the presence of said passages.

13. A vessel as claimed in claim 10 wherein said auxiliary porous refractory liner is made of a material having formed passages porous to said molten metal.

14. A vessel as claimed in claim 10 including means for draining said auxiliary source of molten metal from said vessel.

15. A vessel for ironmaking or steelmaking having a refractory vessel liner subject to corrosive attack by a layer of slag floating on molten metal, comprising:

(a) means within the vessel for establishing and continuously maintaining an auxiliary source of molten metal surrounding but isolated from the layer of slag;

(b) said means for establishing and continuously maintaining said auxiliary source of molten metal including an auxiliary non-porous refractory liner spaced inwardly of said vessel liner and extending above and below the layer of said slag for containing said layer of slag and molten metal below said slag;

(c) means for communicating said molten metal below said layer of slag to the space between said vessel and said auxiliary non-porous refractory liner to establish and continuously maintain said source of molten metal; and (d) means for introducing an inert gas into said source of molten metal through plural entries at a level below said layer of slag to decrease the density of said source of molten metal enabling the metal in said source of molten metal to float upwardly and trickle down the inner surface of said auxiliary non-porous refractory liner to establish and maintain continuously a film of said molten metal obtained from said auxiliary source of molten metal between said refractory liner and said layer of slag in a manner wherein said layer of slag is prevented from making direct contact with said vessel liner.

16. A vessel as claimed in claim 15 including means for draining said auxiliary source of molten metal from said vessel.

17. A vessel for ironmaking or steelmaking having a refractory vessel liner subject to corrosive attack by a layer of slag floating on molten metal, comprising:

(a) means within the vessel for establishing and continuously maintaining an auxiliary source of molten metal surrounding but isolated from the layer of slag;

(b) said means for establishing and continuously maintaining said auxiliary source of molten metal including a porous refractory liner spaced inwardly of said vessel liner and extending above and below the layer of said slag for containing said layer of slag and molten metal below said slag;

(c) means for communicating said molten metal below said layer of slag to the space between said vessel and said porous refractory liner to establish and continuously maintain said source of molten metal; and (d) means for introducing an inert gas into said source of molten metal through plural entries at a level below said layer of slag to decrease the density of said source of molten metal enabling the metal in said source of molten metal to float upwardly and trickle down the inner surface of said porous refractory liner to estabish and continuously maintain a film of said molten metal obtained from said auxiliary source of molten metal and additional molten metal to seep through said auxilairy liner to combine with and supplement other molten metal trickling down and forming said film wherein said layer of slag is prevented from making direct contact with said vessel liner.

18. A vessel as claimed in claim 17 including means for draining said auxiliary source of molten metal from said vessel.

19. A vessel as claimed in claim 17 wherein said auxiliary porous refractory liner is made of a material inherently porous to said molten metal.

20. A vessel as claimed in claim 19 wherein said material includes formed passages porous to said molten metal thereby enabling molten metal from said auxiliary source to seep through said auxiliary porous refractory liner both by reason of the inherent porous character of said material and by the presence of said passages.

21. A vessel as claimed in claim 17 wherein said auxiliary porous refractory liner is made of a material having formed passages porous to said molten metal.

* * * * *

UNITED STATES PATENT AND TRADEMARK OFFICE

CERTIFICATE OF CORRECTION

PATENT NO. : 4,676,486

DATED : June 30, 1987

INVENTOR(S) : Waldo Rall

It is certified that error appears in the above-identified patent and that said Letters Patent is hereby corrected as shown below:

Column 2, line 35 correct "s" to read --is--.

Column 2, line 41 correct "poruos" to read --porous--.

Column 2, line 43 correct "accoring" to read --according--.

Column 3, line 40 correct "moten" to read --molten--.

Column 3, line 43 correct "illsutrated" to read --illustrated--.

Column 3, line 58 correct "lever" to read -- level --.

Column 4, line 43 correct "21" to read --2--.

Column 4, line 33 correct "inner" to read -- liner --.

Column 4, line 44 insert --is-- after "liner".

Column 5, line 62 correct "manenr" to read -- manner --.

Signed and Sealed this

Eighth Day of December, 1987

*Attest:*

DONALD J. QUIGG

*Attesting Officer*

*Commissioner of Patents and Trademarks*